US009788631B2

(12) United States Patent
Little et al.

(10) Patent No.: US 9,788,631 B2
(45) Date of Patent: Oct. 17, 2017

(54) ERGONOMIC APPARATUS WHICH HOLDS COMMERCIALLY AVAILABLE NAIL CLIPPERS IN WORKING POSITION

(71) Applicants: Brian Edward Little, Wilmington, NC (US); Marion Sears Little, Wilmington, NC (US)

(72) Inventors: Brian Edward Little, Wilmington, NC (US); Marion Sears Little, Wilmington, NC (US)

( * ) Notice: Subject to any disclaimer, the term of this patent is extended or adjusted under 35 U.S.C. 154(b) by 0 days.

(21) Appl. No.: 14/966,138

(22) Filed: Dec. 11, 2015

(65) Prior Publication Data

US 2017/0164714 A1 Jun. 15, 2017

(51) Int. Cl.

| | |
|---|---|
| ***A45D 29/00*** | (2006.01) |
| ***A45D 29/02*** | (2006.01) |
| ***A45D 29/22*** | (2006.01) |

(52) U.S. Cl.

CPC ..... *A45D 29/00* (2013.01); *A45D 29/02* (2013.01); *A45D 29/22* (2013.01); *A45D 2029/026* (2013.01)

(58) Field of Classification Search

CPC .... A45D 29/02; A45D 29/033; A45D 29/026; A45D 29/023; A45D 229/026; A45D 29/22

See application file for complete search history.

(56) References Cited

U.S. PATENT DOCUMENTS

| | | | | |
|---|---|---|---|---|
| 4,564,034 A * | 1/1986 | Mackel | A45D 29/02 132/73 |
| 2008/0148572 A1* | 6/2008 | Samson | A45D 29/02 30/28 |
| 2009/0223055 A1* | 9/2009 | Wendorf | A45D 29/02 30/28 |
| 2012/0204891 A1* | 8/2012 | McCourtney | A45D 29/22 132/73.5 |

FOREIGN PATENT DOCUMENTS

JP 11155628 A * 6/1999

OTHER PUBLICATIONS

Milbat website; http://www.milbat.org.il/English/Pages/Grooming.aspx; Oct. 7, 2013.*

Old Age Solutions website; http://www.oldagesolutions.org/General/Archive_gallery.aspx; Sep. 25, 2010.*

* cited by examiner

*Primary Examiner* — Daniel J Colilla

(57) ABSTRACT

This invention enables a physically impaired individual to trim his or her fingernails or toenails with a commercial nail clipper without holding and squeezing the clipper. The device includes a base which holds a small and/or large commercial nail clipper in a removable, reversible sleeve, a hand/foot rest to aid in placing and holding nails between the clipper cutting blades and a lever to be pressed to apply force to the clipper actuating arm and accomplish nail trimming. The primary purpose of the device is to assist individuals in trimming their own fingernails or toenails, especially those (Continued)

who have lost the dexterity in one or both hands or experience pain when squeezing a nail clipper. The invention may also be hand-held by an individual who needs assistance holding and operating a nail clipper.

8 Claims, 6 Drawing Sheets

ERGONOMIC APPARATUS WHICH HOLDS COMMERCIALLY AVAILABLE NAIL CLIPPERS IN WORKING POSITION

PRIOR DISCLOSURE OF INVENTION

Priority is claimed from Provisional Patent Application No. 62/091,377 filed on Dec. 12, 2014 and incorporated by reference herein.

RELATED APPLICATIONS

Not applicable

FEDERALLY SPONSORED RESEARCH OR DEVELOPMENT

Not applicable

PARTIES OF JOINT RESEARCH AGREEMENT

Not applicable

SEQUENCE LISTING

Not applicable

BACKGROUND OF THE INVENTION

The present invention relates to trimming the fingernails and toenails of a human being and may be helpful to an individual who has difficulty gripping and operating commercially available nail clippers. The present invention employs the utility of the common commercial clipper without modification. Such nail clippers are sufficient for use by most people and numerous patents cover methods of modifying the design for easier use although few eliminate the need for the user to hold and squeeze the clipper or to press directly on the actuating arm.

The common commercial nail clippers are in mass production and typically share a design having two spring steel members joined at one end, having opposing blades on the opposite end, and operated by an actuating arm pivoting on a notched post, closing the blades with an enhanced force when the actuating arm is pressed. The tapered shape, smooth, hard, surfaces, and included angle between the clipper lower member and the actuating arm often cause the actuating arm to swivel out of position or slip from the user's grip when attempting to trim fingernails or toenails. In addition, squeezing a nail clipper or simply pressing directly on the actuating arm may be painful for some persons.

This invention provides a nail clipper holding and operating apparatus which enables the user to trim fingernails and toenails by simple downward pressure on a lever which applies force to the actuating arm of the common commercial nail clipper.

In the prior art, various devices are marketed to hold a common commercial nail clipper in or on a base to be placed on a flat surface including the Tabletop Nail Clipper, a plastic block with a nail clipper mechanically attached An early U.S. Pat. No. 4,564,034 A, now inactive, disclosed a nail clipper holder which provided a block having cavities to house the commercial nail clippers with the cutting blades protruding and the actuating arm exposed. Although this device and similar devices would provide some assistance with nail trimming, they offer no hand or foot rest to anchor the device and no lever to eliminate the need for the user to press directly on the clipper actuating arm. Patent CN202396750 U is a Nail Clipper For Person With One Hand, presently marketed, which requires relatively good coordination and limits visibility of the clipper blades.

No known device provides the advantages of the present invention which include providing:

1. an apparatus to hold a common commercial nail clipper and trim a fingernail or toenail by pressing a lever rather than pressing directly on the clipper actuating arm;
2. an apparatus to hold and operate said commercial nail clipper on a flat surface with the cutting blades at a convenient and comfortable height above the flat surface;
3. a hand or foot rest to anchor the apparatus while the user places and holds a nail between the cutting blades of the clipper for trimming;
4. an apparatus which may be hand-held for nail trimming by squeezing the base and lever together;
5. an apparatus which be manufactured and marketed specifically for hand-held use by deleting the hand/foot rest;
6. an apparatus to which a handle may be temporarily attached to place the apparatus on the floor for toenail trimming;
7. an apparatus which can be used without the user holding a hand or foot higher than the surface on which the base rests;
8. an apparatus which can hold and operate either fingernail clippers or toenail clippers;
9. an apparatus which can hold and operate commercial fingernail and toenail clippers without the need for mechanical fasteners or adhesives;
10. an apparatus that can be molded of plastic and requires no tools for assembly;
11. an apparatus which may be sanitized with dishwashing detergent and water;
12. an apparatus which is well suited for use by a person whose dexterity or flexibility is limited by autoimmune disease, stroke, injury, or arthritis.

Numerous persons, because of injury, body configuration, spasticity, ageing, or disease have lost the strength or agility in one or both hands to apply pressure between the thumb and finger(s) in a coordinated pinching motion. Such limitations make it difficult or impossible for an impaired person to use commercially available fingernail clippers, toenail clippers, scissors, or diagonal cutters to trim their own nails. The present device does not require handling fasteners or tools, making the device helpful for impaired persons.

Many nail trimming devices are small to facilitate transport in a pocket or purse. There is a need for an apparatus for trimming fingernails and toenails that is larger and easier to handle than the commercial clipper. The apparatus must be lightweight and stable enough for an impaired person to use when it is placed on a table or floor and eliminates the need to hold and squeeze the clipper. Other persons may only need a hand-held device which holds the clipper and is operated by squeezing with the fingers and palm.

BRIEF SUMMARY OF THE INVENTION

The present invention is an ergonomic apparatus which holds a common, commercial fingernail clipper and/or a toenail clipper, enables a handicapped person to position and hold his or her nails between the clipper cutting blades, and trim the nails by pressing a lever rather than directly gripping and squeezing the clipper. For individuals who are able to grip the apparatus, it may be used as a hand-held tool, providing an apparatus which holds the clippers on the base and a lever which, when squeezed, transfers force to the clipper actuating arm, eliminating the need to directly grip and squeeze the clipper.

DESCRIPTION OF INVENTION

Figure 1:
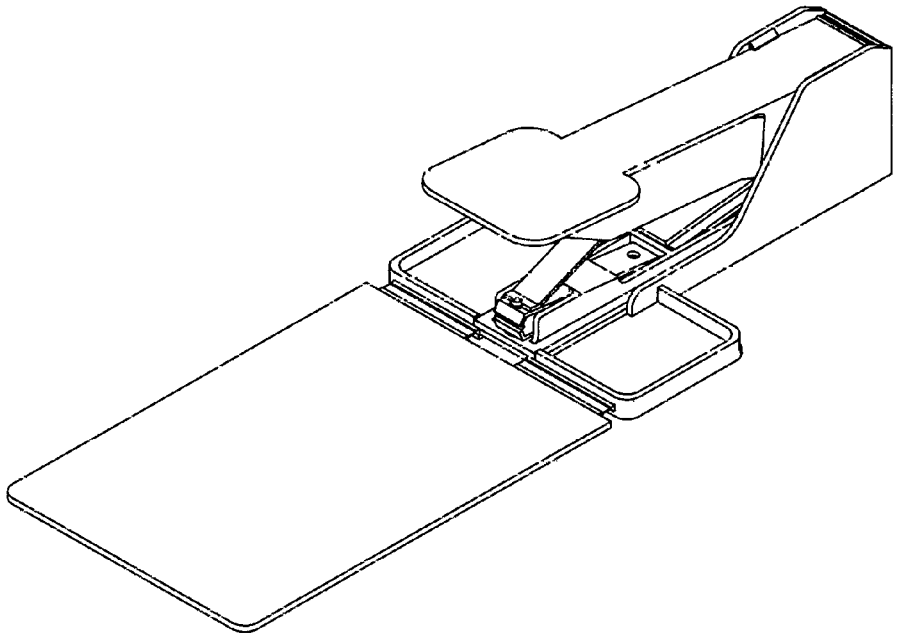
FIG. 1 is a perspective view of the present invention which is constructed in accordance with the preferred embodiment of the present invention.
Figure 2:
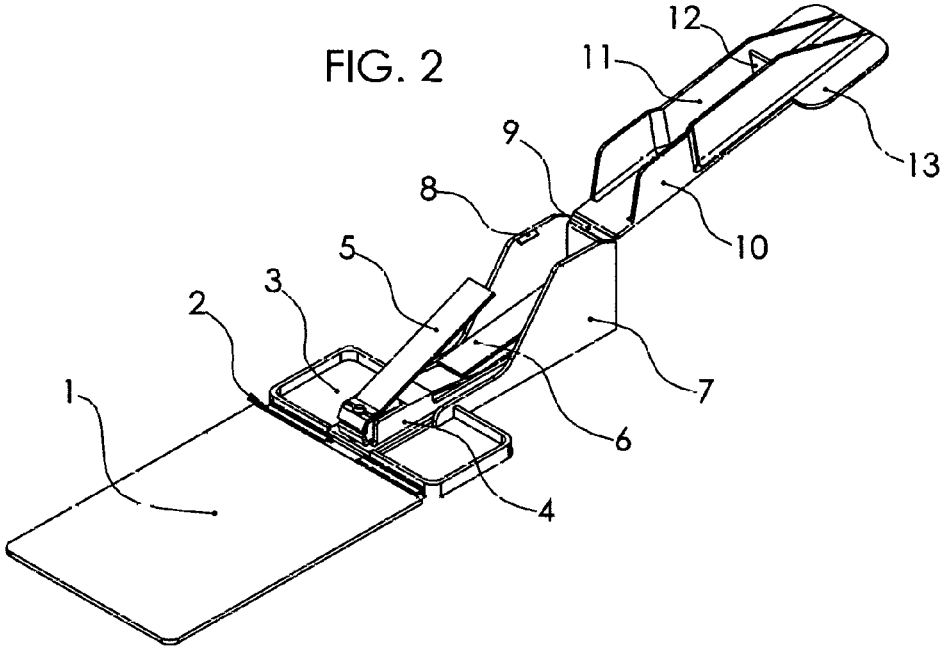
FIG. 2 is a perspective view showing all components of the present invention with the hinged lever in the open position.

FIG. 1-4 show the preferred embodiment of the present invention which holds commercially available nail dippers 5, 6 on a base 3, a band/foot rest 1, a hinge bracket 7, and a lever 10 that applies force to the actuating arm of the commercial clipper. The hand/foot rest and the lever are attached to the base with molded or pressed living hinges 2, 9. The handle FIG. 5 may be temporarily attached to the lever. The commercial dipper FIG. 6 is often referred to in this document.

The present invention has a flat base 3 to place on a flat surface and a lever 10 which is larger and more stable than the clipper actuating arm 26 and has an enlarged area 13 on which to press to perform nail trimming action. The lever has a channel underside 11 to restrain the clipper actuating arm and a push bar 12 to concentrate the force on the actuating arm.

Figure 3:
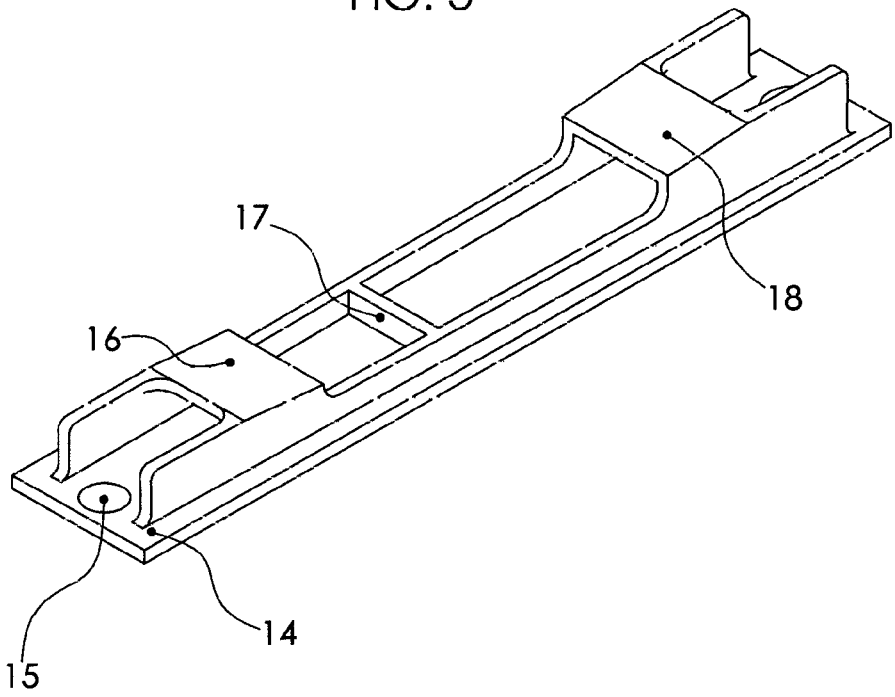
FIG. 3 is a perspective view of the clipper holding sleeve.
Figure 4:
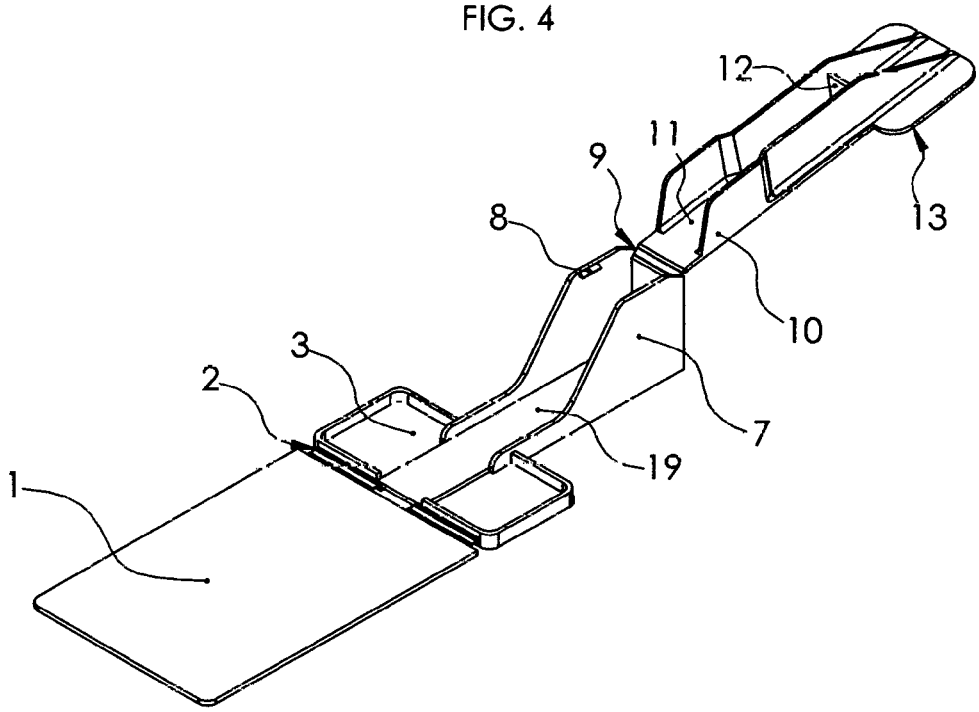
FIG. 4 is a perspective view of the hand/foot rest, living hinge, base, hinge bracket, living hinge, and lever as molded in one piece.

The apparatus includes a sleeve 4, FIG. 3 which holds a small clipper 5 and a large clipper 6 and is comprised of a base 14 with a bracket 16 to hold a small clipper, a bracket 18 to hold a large clipper, and a stop 17 to limit the depth either clipper may be inserted in the bracket. The sleeve also includes a semispherical depression 15 on both ends of its base to accept the rounded head of the notched post of the commercial clipper and help retain each clipper in the bracket.

The present invention has a roughly rectangular hand rest 1 that is attached to the base with a living hinge 2. With the hand on the hand rest, the base and clipper are less likely to be pushed away while the nail is being placed and held between the clipper blades 23, 24, thus minimizing the need to secure the unit to a surface or brace it against a stationary object. The hand rest may also serve as a foot rest for toenail trimming. The hand rest may have holes to reduce the material requirement and for traction or aesthetic purposes.

The relatively flat base has a receiver channel 19 for the reversible sleeve FIG. 3 and includes a bracket 7 that supports a hinge 9 for the lever 10 and helps to keep the lever aligned. The hinge bracket has clips 8 to keep the lever in the operating position and permit lifting the apparatus by the lever.

The hinge 9 for the lever 10 may be a molded or pressed plastic living hinge. The lever has a channel shaped underside 11 to keep the commercial clipper actuating arm 26 from swiveling out of alignment while the lever and base enable the pinching action required for cutting nails. The top of the lever may have an enlarged area 13 where pressure is applied for nail cutting. The enlarged area of the lever is located directly above the clipper to ensure the apparatus stays in place during the trimming action.

Figure 5:
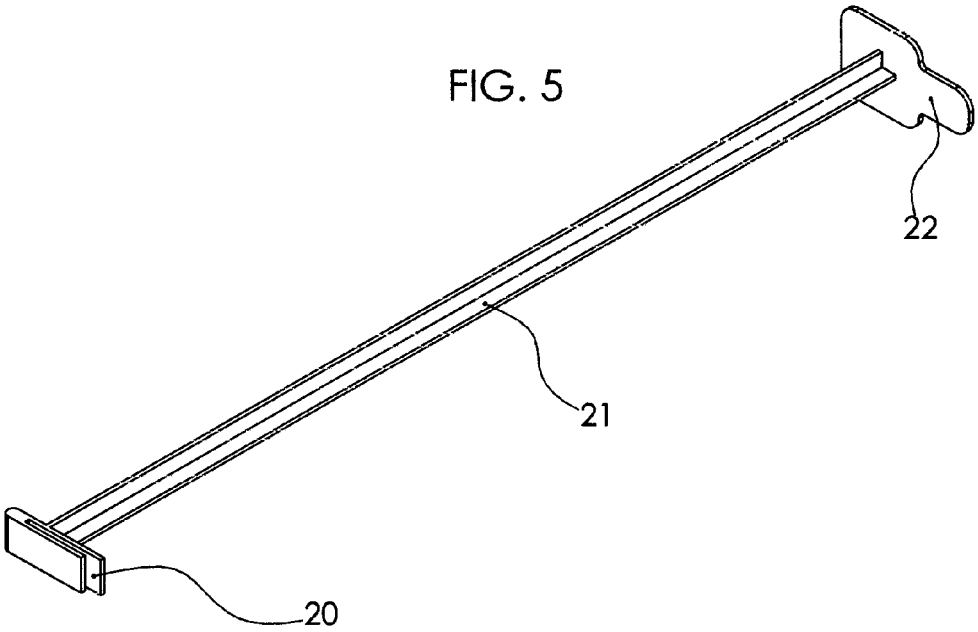
FIG. 5 is a perspective view of the handle.
Figure 6:
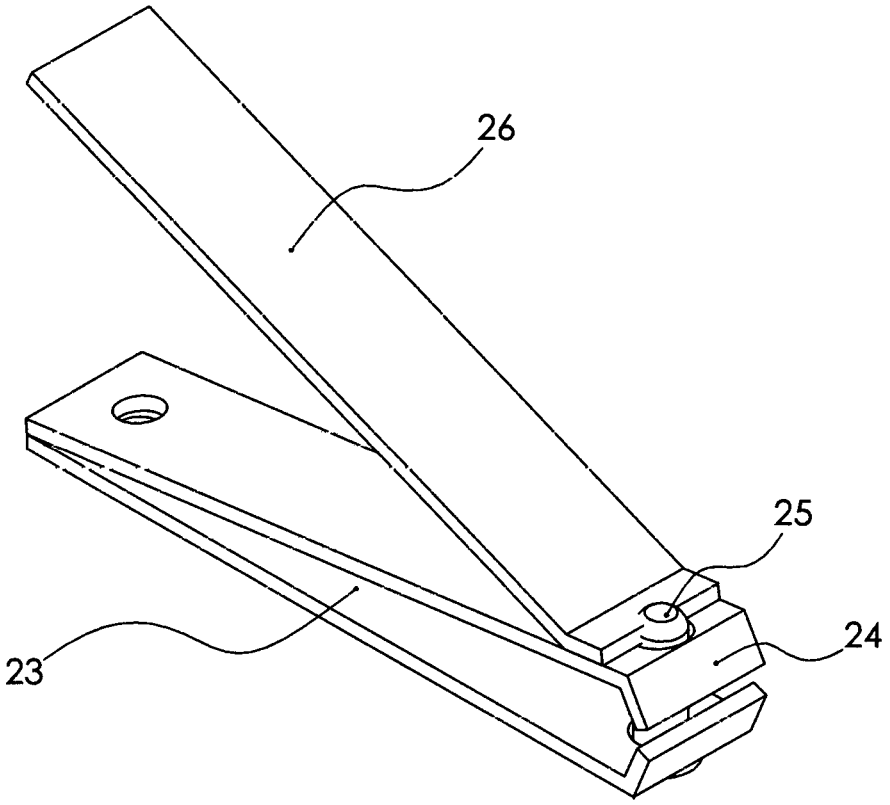
FIG. 6 is a perspective view of a commercial nail clipper.

The present invention may be molded in three parts, the first part consisting of the hand rest, base, and lever, connected by living hinges; the second part being the reversible clipper-holding sleeve, and the third part being the handle FIG. 5.

Alternatively, the present invention may be molded as a single part, consisting of the base with a clipper holding sleeve molded integrally, the hand rest, and the lever, connected with living hinges. The manufacturer may choose to omit the handle.

For trimming toenails, a user may install the handle FIG. 5 by slipping the adapter 20 onto the enlarged end of the lever. The handle assembly will stay attached to the lever and the entire assembly may be lifted and placed on the floor in position for inserting toenails between the clipper blades. The length of the shaft 21 shall be determined by the manufacturer. The handle may be pushed downward with the knob 22 for toenail trimming. The handle is easily removed when not needed. If the handle is not included with the basic clipper gripper, a user may be able to position his or her toenails between the clipper blades and press the lever with a hand or convenient object.

A second embodiment of the present invention is hand-held, is supplied without the hand/foot rest and handle, and may have a more compact base.

Advantages of the Present Invention Over Previous Inventions

1. Present invention allows the user to trim nails without requiring direct finger and thumb pressure on the clipper, an action which may be painful or difficult to control by a person with disease or poor coordination.
2. Present invention provides a hand rest to aid in anchoring the clipper and inserting and holding the nail between the clipper blades.
3. Present invention positions the clipper blades at a height permitting the finger or toe to rest comfortably on the hand/foot rest.
4. Present invention utilizes mass-produced commercial fingernail and/or toenail clippers which may be more economical than producing unique nail clippers which could require special tooling and handling.
5. Present invention provides the versatility to be used on a flat surface or be hand-held.
6. Present invention may be molded in one part, two parts, or three parts, greatly reducing post-molding labor.
7. Present invention provides a hand/foot rest which may be folded under the base for storage.
8. When used on a flat surface, the present invention has a stable base and lever for applying cutting pressure with the opposite hand or arm, lessening the need for fine coordination.
9. Present invention enables easy replacement of dull clippers and requires no tools for the replacement.
10. Present invention uses over-the-counter commercial fingernail and toenail clippers which need no disassembly or modification.
11. Present invention permits switching between sizes of clippers without the use of tools.

12. Present invention may be constructed to use many types, sizes, and styles of clippers.
13. Present invention provides a reversible sleeve giving the user a choice between two clippers.
14. Present invention may be constructed to use one clipper or two clippers.
15. Present invention may be constructed entirely of molded plastic parts with no additional fasteners or pins.
16. Present invention requires no tools for assembly.
17. Present invention restrains the clipper actuating arm, preventing the arm from swiveling out of alignment, a feature not included or evident in other clipper holding devices which only hold one part of the clipper.
18. Present invention provides space on both sides of the clipper for the fingers or toes that are not undergoing nail trimming.
19. Present invention positions the clipper blades for unobstructed access in trimming edges of nails.
20. Present invention permits good visibility of the position of the nail between the clipper blades.
21. Present invention has an open design with no hidden component to be of concern to persons with limited technical understanding.
22. Present invention has no electrical component in standard configuration.
23. Present invention is all plastic and may be sanitized in soap and water.
24. Present invention aids in positioning nails for trimming and may be easier for cutting toenails than a clipper mounted at the end of an extension device.
25. Present invention has a hinge support bracket which guides the sides the lever.
26. Present invention has an easy-to-attach/detach handle for positioning the device and trimming toenails by a user who has trouble reaching his or her feet.
27. Present invention has a clip or clips built into the hinge bracket for the lever that limit the upward travel of the lever during lifting and moving.
27. Present invention enables trimming of toenails with the foot resting naturally on the floor rather than being held up to meet an elevated clipper.

Making the Device

The components of the device may be constructed of rigid or semi-rigid plastic using machining, injection molding, 3-D printing, or other yet-to-be-developed plastic molding process, or of metal. The clipper holding sleeve may be made of flexible plastic to accommodate slightly different size clippers. Although injection molded plastic is likely the most economical and practical choice of manufacture and material, parts could be hand crafted if desired. In addition, the shaft of the handle may be wood, plastic, or metal. This description of materials and manufacturing methods applies to all of the specialized parts.

Best Mode Construction

The present invention's best mode is injection molded thermoplastic and is comprised of a hand rest, a base, and a lever connected by living hinges as one part, a removable and reversible sleeve as a second part, and a removable handle as a third part. The hinged hand rest may be folded under the base when not needed or for storage.

Alternate Construction

1. The device may be constructed in multiple pieces and different configurations.
2. The hand rest may be molded or fabricated with one plain end and the opposite end rigidly connected to the base, or it may be constructed with the base.
3. The hand rest may be fitted with tabs which slip into tracks on the base, may be attached with conventional hardware, or may have a conventional mechanical hinge.
4. The base may be plastic, metal, natural material, or composite.
5. The lever hinge support may be plastic, metal, natural material, of composite.
6. The lever hinge may be a tab and slot or may be a conventional type, with one part attached to the base and the other attached to the lever.
7. The channel on the base that accepts the sleeve may be molded with the base or fabricated of plastic, metal, or natural material.
8. The sleeve may be plastic, metal, or natural material.
9. The sleeve may be permanently replaced with brackets or clips to retain one nail clipper.
10. The sizes and shapes of the brackets, clips, and sleeve may be varied to accommodate clippers of different sizes and shapes.
11. The sleeve may be eliminated and the channel may be made to hold a small clipper or a large clipper with an adapter to hold a smaller clipper.
12. The reversible sleeve, which holds two clippers, may be replaced with one or more sleeves to each hold a single clipper.

How to Set Up and Use the Present Invention

1. Load the chosen, active clipper of the desired size in one end of the sleeve with the cutting blades facing outward and its actuating arm up.
2. If desired, load a second, passive, clipper in the opposite end of the sleeve with the cutting blades facing outward and its actuating arm folded on top of the bracket on the sleeve. Note that the sleeve is designed to accept many commercially available fingernail clippers and larger toenail clippers.
3. Depress the actuating arm of the active clipper and slide the loaded sleeve into the channel under the lever with the blades of the active clipper facing outward.
4. For easy positioning of fingers and toes, unfold the hand rest and place the unit on a flat surface. Place and hold nails between the clipper blades. Trim nails by pressing downward on the lever while keeping the device on the stable surface. For storage, fold the hand rest under the unit.
5. For toenail trimming by the user who is able to bend and reach his or her feet while seated, place the unit on the floor with the ball of the foot on the hand/foot rest. Position the toenail between the clipper cutting blades and press the lever to trim the nail.
6. For the user who is not able to reach his or her feet while seated, the user may slip the handle onto the larger end of the lever, being certain that one tab at the end of the handle fits on top of the lever and the other fits under the lever. Use the handle to place the unit on the floor. Using the hand rest as a foot rest, position a toenail between the blades of the clipper; push downward on the handle to trim the toenail. Note that very thick nails should be trimmed in small portions from the edges.
7. The device may be hand-held by allowing the hand/foot rest to hang freely.

Possible Enhancements or Alternatives

1. Include a light under the lever above the clipper blades or on a flexible mount.

2. Include a light-transmitting plastic portion of the base and a light source to illuminate the tip of the finger or toe from beneath the finger or toe.
3. Include a magnifying glass above the clipper blades on a flexible mount.
4. Make the lever longer to further multiply the force on the commercial clipper actuating arm.

MANUFACTURING NOTES

1. All parts of the present invention may be made by injection molding, minimizing labor.
2. All plastic parts may be made of Polypropylene, High Density Polyethylene, or other thermoplastic with similar properties which enable the use of living hinges.
3. The sleeve may be molded of Low Density Polyethylene or an elastomer to accommodate different sizes and shapes of commercial clippers.
4. The handle may be made entirely by injection molding or the ends of which may be molded and fitted to plastic or metal rod or tubing, or wooden dowel, by press fit, shrink fit, or adhesive.
5. Assembly of the other molded parts requires no tools or hardware such as fasteners or adhesive.

The invention claimed is:

1. A commercial nail clipper holding and operating apparatus comprising:

a base;

a hand/foot rest attached to the base with an integrally molded living hinge; and a lever attached to the base with an integrally molded living hinge wherein the lever has a channel on an underside to operate the clipper and prevent a clipper actuating arm from swiveling out of alignment, wherein the base further includes a channel for holding a commercial fingernail clipper so that blades of the fingernail clipper are adjacent to the hand/foot rest.

2. The commercial nail clipper holding and operating apparatus according to claim 1, further comprising a removable sleeve that fits into the channel on the base and is capable of holding a small fingernail clipper in one end and a larger toenail clipper in an opposite end.

3. The commercial nail dipper holding and operating apparatus according to claim 1, wherein the base is rigid, so that it will be stable when placed on a table, counter, or floor, and generally "T" shaped when viewed from above.

4. The commercial nail clipper holding and operating apparatus according to claim 3, wherein the hand/footrest is rigidly or hingedly attached to a larger end of the base to the top of the "T" shape so that the apparatus is prevented from sliding away from the user.

5. The commercial nail clipper holding and operating apparatus according to claim 1, further comprising a removable and reversible sleeve that fits into the channel on the base is capable of selectively holding differently sized nail clippers which are replaceable without the use of tools.

6. The commercial nail clipper holding and operating apparatus according to claim 5, wherein the removable and reversible sleeve, in a first position, is capable of holding a small fingernail clipper with blades of the clipper adjacent the base, and in a second, reversed position, is capable of holding a larger toenail clipper in an opposite end of the sleeve with blades of the clipper adjacent to the base.

7. The commercial nail clipper holding and operating apparatus according to claim 1, wherein the channel on the base is an integrally molded for holding a commercial nail clipper by friction fit or by use of bread bag ties through holes in the base.

8. The commercial nail clipper holding and operating apparatus according to claim 1, further comprising a detachable handle to be used for placing the device on a floor and for pressing downward on the lever for toenail trimming.

* * * * *